US005778718A

United States Patent [19]

Stinnertz et al.

[11] Patent Number: 5,778,718

[45] Date of Patent: Jul. 14, 1998

[54] PROCESS FOR ROLLING TUBES

[75] Inventors: Horst Stinnertz, Willich; Michael Baensch, Mönchengladbach, both of Germany

[73] Assignee: Mannesmann Aktiegesellschaft, Dusseldorf, Germany

[21] Appl. No.: 853,077

[22] Filed: May 8, 1997

[30] Foreign Application Priority Data

May 8, 1996 [DE] Germany ..... 196 20 161.6

[51] Int. Cl.[6] ..... B21D 7/02

[52] U.S. Cl. ..... 72/214; 72/208; 72/249

[58] Field of Search ..... 72/208, 209, 214, 72/249, 250, 365.2, 370

[56] References Cited

U.S. PATENT DOCUMENTS

| | | | |
|---|---|---|---|
| 5,076,088 | 12/1991 | Klingen et al. | 72/249 |
| 5,125,253 | 6/1992 | Gerretz et al. | 72/208 |
| 5,419,173 | 5/1995 | Baensch et al. | 72/249 |
| 5,606,885 | 3/1997 | Baensch et al. | 72/214 |

FOREIGN PATENT DOCUMENTS

| | | |
|---|---|---|
| 167742 | 2/1906 | Germany . |
| 907763 | 7/1953 | Germany . |
| 3708943 | 12/1987 | Germany . |

*Primary Examiner*—Lowell A. Larson
*Assistant Examiner*—Ed Tolan
*Attorney, Agent, or Firm*—Cohen, Pontani, Lieberman & Pavane

[57] ABSTRACT

A process for rolling tubes, in which two grooved rolls mounted opposite one another in a roll stand are moved back and forth, i.e., reciprocated, on tube-shaped rolling material, which is arranged on a tapered rolling mandrel supported in the axial direction by a mandrel bar. The rotary-driven rolls have, on their circumferential surfaces, narrowing work grooves matching in shape to the tapered rolling mandrel, which roll down the rolling material on the rolling mandrel. At the ends of the work passes the rolls release the rolling material at the two dead centers of the roll stand path so as to assist in the advancement and rotation of the rolling material. According to the invention, the tube-shaped rolling material and the rolling mandrel are driven asynchronously in the same rotational direction at different rotational speeds.

3 Claims, No Drawings

PROCESS FOR ROLLING TUBES

BACKGROUND OF THE INVENTION

1. Field of the Invention

The present invention relates to a process for rolling tubes or pipes, in which two grooved rolls mounted across from one another in a roll stand are moved back and forth, i.e., reciprocated, on tube-shaped rolling material or work piece, which is arranged on a tapered or conical-shaped rolling mandrel held in the axial direction by a mandrel bar. The rotary-driven rolls or dies, on their circumferential surface, have narrowing or tapered working grooves or passes matching in shape to the tapered rolling mandrel, which roll down the rolling material on the rolling mandrel. At the end of the working passes, the rolls release the rolling material at the two dead centers of the roll stand path which aids in advancement and rotation of the rolling material. 2. Description of Related Art A rolling process for producing tubes or pipes, known as the "reciprocating rolling process", is described, for example, in German patent publication 37 08 943 C1, herein incorporated by reference in its entirety. In accordance with this type of rolling process, the rolling material or work piece is generally rotated and advanced at one or both dead centers of the roll stand, while remaining substantially at rest during the actual rolling operation. To rotate the rolling material, very high rolling moments are needed in a short time, the accelerating moments of which limit the performance capacity of the cold pilger process and its devices.

Cold pilger mills of this type, therefore, require relatively expensive mechanisms to synchronously rotate the tube-shaped rolling material and the rolling mandrel at the dead centers of the roll stand path after the work rolls, due to their roll pass shape, release the tube-shaped rolling material.

Processes and devices have already been proposed in which the rotation and advancement of the rolling material is approximately constant. However, these processes are only suitable for use with sufficiently flexible rolling material because the rotation of the rolling material which occurs during contact between the rolling material and the rolling mill dies is stored elastically in the tube-shaped rolling material. The known manufacture or process therefore requires a portion of the advance rate and/or a portion of the rotational angle of the rolling material to be transferred per work cycle to the rolling material in the form of a constant movement, while another portion of the movement is imposed discontinuously or irregularly.

In addition, it is also known to simplify the drive by fixing the mandrel bar, without the rotary drive, axially so that it rotates with the rolling material. In this construction the rotation of the rolling mandrel and that of the rolling material is synchronous with respect to rotational direction and rotational speed. These conventional apparatuses and processes have several disadvantages. A system with intermittent synchronous rotation of the mandrel bar and the rolling material is relatively expensive and is prone to malfunction. As for systems having mandrel bars without their own rotary drive, flashes may be produced at the clamping points thereby causing concealed damage to the interior surface of the rolling material. In the case of permanent or fixed rotation of the rolling material and the mandrel bar, the clamping devices for the rolling material may result in slippage and incomplete rotation of the rolling material. Moreover, with this construction, the rotary drives may be overloaded and the extent of surface damage to the rolling material and/or wear on the rolls may increase.

The object of the present invention is, therefore, to provide a simplified and an economical rotary drive for the rolling material, to achieve a relatively high number of strokes of the cold pilger mill and thus to attain relatively high production output at relatively low construction cost.

DETAILED DESCRIPTION OF THE PRESENTLY PREFERRED EMBODIMENTS

In accordance with the present inventive process for rolling seamless tubes or pipes the tube-shaped rolling material or work piece and the rolling mandrel are driven asynchronously in the same rotational direction at different rotational speeds.

Until now generic cold pilger rolling processes have required synchronous movement of the tube-shaped rolling material and the rolling mandrel in that the rolling material and rolling mandrel are freely rotated together. The present inventive cold pilger rolling process drives the rolling mandrel at a rotational speed different from that of the rolling material and produces a torsional moment during the rolling phases or operation so that the rolls or dies of the cold pilger mill hold or secure the tube-shaped rolling material to the mandrel bar. When the tube-shaped rolling material is released at the dead centers of the roll stand, this torsional moment assists the rotational movement of the rolling material. As a result, the cold pilger mill produces a higher number of strokes in situations where otherwise, in view of the tube rotation, the number of strokes would be reduced. Therefore, the economic efficiency of the rolling mill is improved or enhanced.

The overall efficiency of the rolling mill is also improved by driving the rolling mandrel at a substantially constant rotational speed. As a result of driving the rolling mandrel at a substantially constant rotational speed, a simplified construction of the rotational-advance drive of the cold pilger is used. The rolling mandrel is driven continuously at a substantially constant rotational speed even during the rolling phase or operation in which the rolling material is pressed against the rolling mandrel and both are substantially prevented from rotating. During the rolling phase the continuous rotary drive of the rolling mandrel produces or generates a torsional moment which amasses or builds-up in the relatively long mandrel bar and is momentarily relieved at the instant when the tube-shaped rolling material is released by the rolls. Thus, the torsional moment aids in rotating the rolling material when it is released by the rolls.

In the present inventive process, it is irrelevant whether the substantially constant rotation of the rolling mandrel and the intermittent rotational movement of the rolling material occur in a uniform or steady and similar rotational direction or whether the direction of rotation is reversed following certain torsional angles of the rolling material. In either case, driving the rolling mandrel at a substantially constant rotational speed simplifies the kinematics of the drive. Thus, in one embodiment, a substantially constant rotating motor may be provided, while in an alternative embodiment, a drive, as for example that used to drive a windshield-wiper gear, in which a crank mechanism reverses the rotational direction of a motor rotating in one direction may be used.

The process for rolling tubes according to the invention increases the productivity of a cold pilger mill while reducing costs in that the number of strokes is increased as a result of the assisted rotation of the tube-shaped rolling material. Moreover, the simplified rolling mill mechanism not only reduces manufacturing costs, but also reduces the costs of maintaining a stock of replacement parts and improves operational reliability in that fewer moving parts are required.

Thus, while there have been shown and described and pointed out fundamental novel features of the invention as applied to preferred embodiments thereof, it will be understood that various omissions and substitutions and changes in the form and details of the device illustrated, and in their operation, may be made by those skilled in the art without departing from the spirit of the invention. For example, it is expressly intended that all combinations of those method steps which perform substantially the same function in substantially the same way to achieve the same results are within the scope of the invention. Substitutions of elements from one described embodiment to another are also fully intended and contemplated. It is the intention, therefore, to be limited only as indicated by the scope of the claims appended hereto.

We claim:

1. A process for rolling tubes in a grooved rolling mill having two rotary-driven rolls mounted opposite one another in a roll stand which are reciprocated on a tube-shaped rolling material arranged on a tapered rolling mandrel supported in an axial direction by a mandrel bar, wherein the rolls have, on their circumferential surface, narrowing work grooves substantially matching in shape to the tapered rolling mandrel, which roll down the rolling material on the rolling mandrel with each working pass of the rolls, whereby at the end of the working passes the rolls release the rolling material at the two dead centers of the roll stand path so as to advance and rotate the rolling material, the process comprising the step of:

driving asynchronously the tube-shaped rolling material and the rolling mandrel in the same rotational direction at different rotational speeds.

2. The process is accordance with claim 1, wherein the rolling mandrel is driven at a substantially constant rotational speed.

3. The process in accordance with claim 2, wherein a torsional moment is generated in the rolling mandrel when it is driven at the substantially constant rotational speed during the rolling process so as to rotate the tube-shaped rolling material.

* * * * *